United States Patent [19]

Hörmann

[11] Patent Number: 4,893,666

[45] Date of Patent: Jan. 16, 1990

[54] ARTICULATED OVERHEAD GATE

[75] Inventor: Michael Hörmann, Steinhagen, Fed. Rep. of Germany

[73] Assignee: Hörmann KG Brockhagen, Steinhagen/Brockhagen, Fed. Rep. of Germany

[21] Appl. No.: 230,295

[22] Filed: Aug. 9, 1988

[30] Foreign Application Priority Data

Aug. 11, 1987 [DE] Fed. Rep. of Germany ..... 3726699
May 18, 1988 [DE] Fed. Rep. of Germany ..... 3816985

[51] Int. Cl.[4] ..... E05D 15/10

[52] U.S. Cl. ..... 160/229.1; 160/201; 160/40

[58] Field of Search ..... 160/201, 40, 229.1

[56] References Cited

U.S. PATENT DOCUMENTS

| | | | |
|---|---|---|---|
| 3,198,242 | 8/1965 | Crosswell | 160/229.1 X |
| 3,302,690 | 2/1967 | Hurd | 160/201 X |
| 3,319,697 | 5/1967 | Krohn | 160/229.1 |
| 3,334,681 | 8/1967 | Crosswell | 160/201 X |
| 3,347,305 | 10/1967 | Urbanick | 160/201 X |
| 3,424,222 | 1/1969 | Stoner et al. | 160/201 X |
| 3,941,180 | 3/1976 | Thill | 160/201 X |
| 4,269,253 | 5/1981 | Ziegler | 160/201 |
| 4,518,026 | 5/1985 | Otto et al. | 160/201 X |

*Primary Examiner*—Ramon S. Britts
*Assistant Examiner*—David M. Purol
*Attorney, Agent, or Firm*—Max Fogiel

[57] ABSTRACT

Articulated overhead gate consisting of a series of adjacent and interarticulated panels with their sides facing one another, characterized in that the side of each panel that is uppermost in gate-closed state and faces a preceding panel has a curved surface that is convex in vertical section and the side that is lowermost and faces a subsequent panel has a curved surface that is concave in vertical section, with the result that the mutually facing convex and concave curved surfaces in each pair of adjacent panels demarcate a space that is dictated by the hinge between the panels and accordingly has curved edges, and in that the facing sides shift in relation to each other as they articulate around their associated axis of articulation during the transition from the gate-closed state into the gate-open state in such a way that the space remains but decreases along the direction of articulation during at least part of the transition into the state of maximum articulation.

28 Claims, 12 Drawing Sheets

FIG. 8
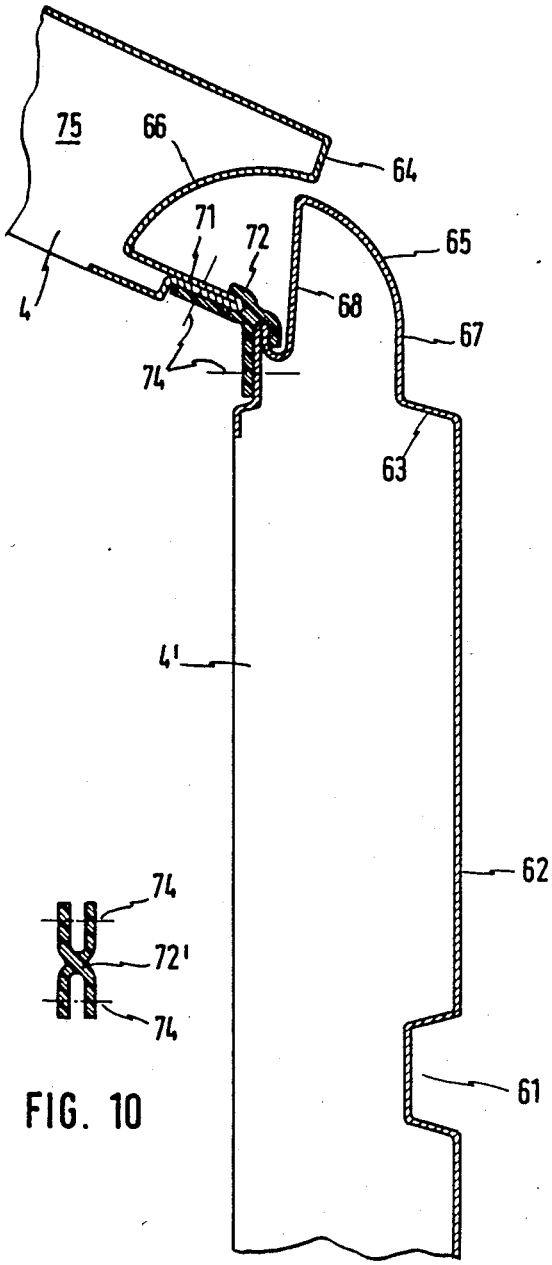
FIG. 9
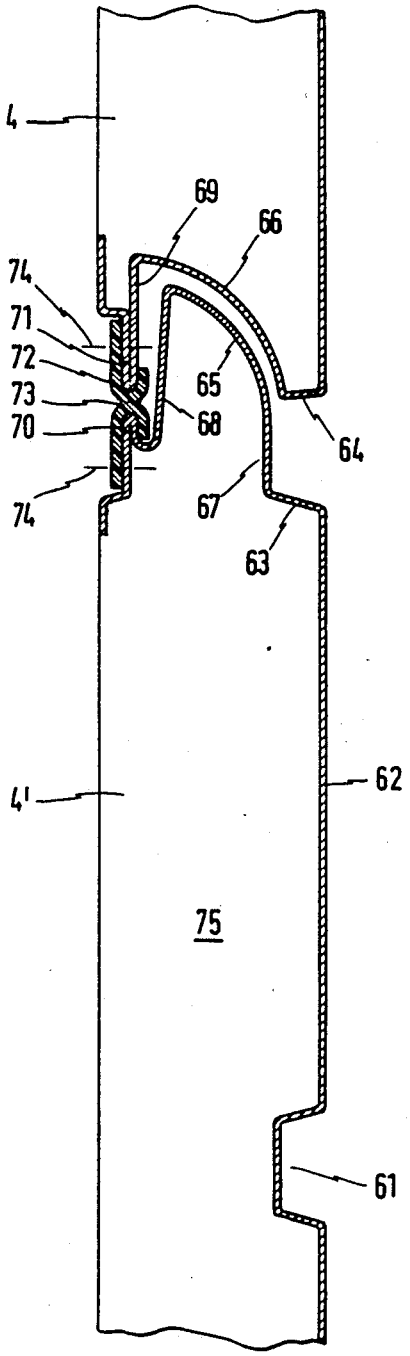
FIG. 10

ARTICULATED OVERHEAD GATE

BACKGROUND OF THE INVENTION

As the closed gate opens and vice versa, the panels travel along a curved path between a more or less straight and vertical section associated with its closed state and a more or less horizontal section associated with its open state. The panels are accordingly connected by means of hinges. The axes of the hinges are located on the inner surface of the leaves, the surface facing the building that the gate is intended to close off. Since the outer surfaces of the panels separate from each other as they travel along the curved section of the path while the gate is being swung open or closed, gaps of a width that depends on the angle of articulation between them, and it is possible to insert the fingers into the gaps. This situation can not only invite closing the gate incorrectly but can also lead to the fingers being unintentionally inserted. The gaps narrow while the gate is being closed, and the fingers can be caught therein.

It is generally impossible to position the panels with their edges far enough apart with the gate closed to prevent the fingers from getting caught, because the gate would not be tight enough and would be at least "drafty". This is especially true when there is a seal between the facing sides of the panels that is intended to ensure that the gate will be tight between the adjacent panels.

The object of the invention is to provide an articulated overhead gate of the aforesaid type that will not entail the risk of getting the fingers caught in it even though the panels will be immediately adjacent to one another.

The design of the facing sides of two adjacent panels in accordance with the invention eliminates, along at least a major portion of the section of articulation, any gap in the outer surface of the gate that it would be possible to insert the fingers into. It is, however, still possible to leave a gap during the state of maximum articulation that will be too narrow to insert the fingers into and preferably narrower than 4 mm. Another embodiment utilizes a seal over the gaps during the state of maximum articulation that prevents the fingers from being inserted between the panels that have been swung up.

Preferred embodiments of the invention will be evident from the subsidiary claims in conjunction with the drawing, to which particular reference is directed and which will illustrate the specification that follows.

BRIEF DESCRIPTION OF THE DRAWINGS

FIG. 8 is a section through part of the joint between two adjacent and mutually articulated panels, with the upper panel pivoted in relation to the lower one, which is in an upright plane, FIG. 9 illustrates the panels in FIG. 8 in the state (with the gate closed) in which both panels are in an essentially upright plane, FIG. 10 is a section trough a strip of plastic with two pairs of equally long legs, FIG. ll is a side view of the joint between two panels at maximum articulation, in an intermediate state, and straight, with the gate closed.

DESCRIPTION OF THE PREFERRED EMBODIMENT

Figure 1:
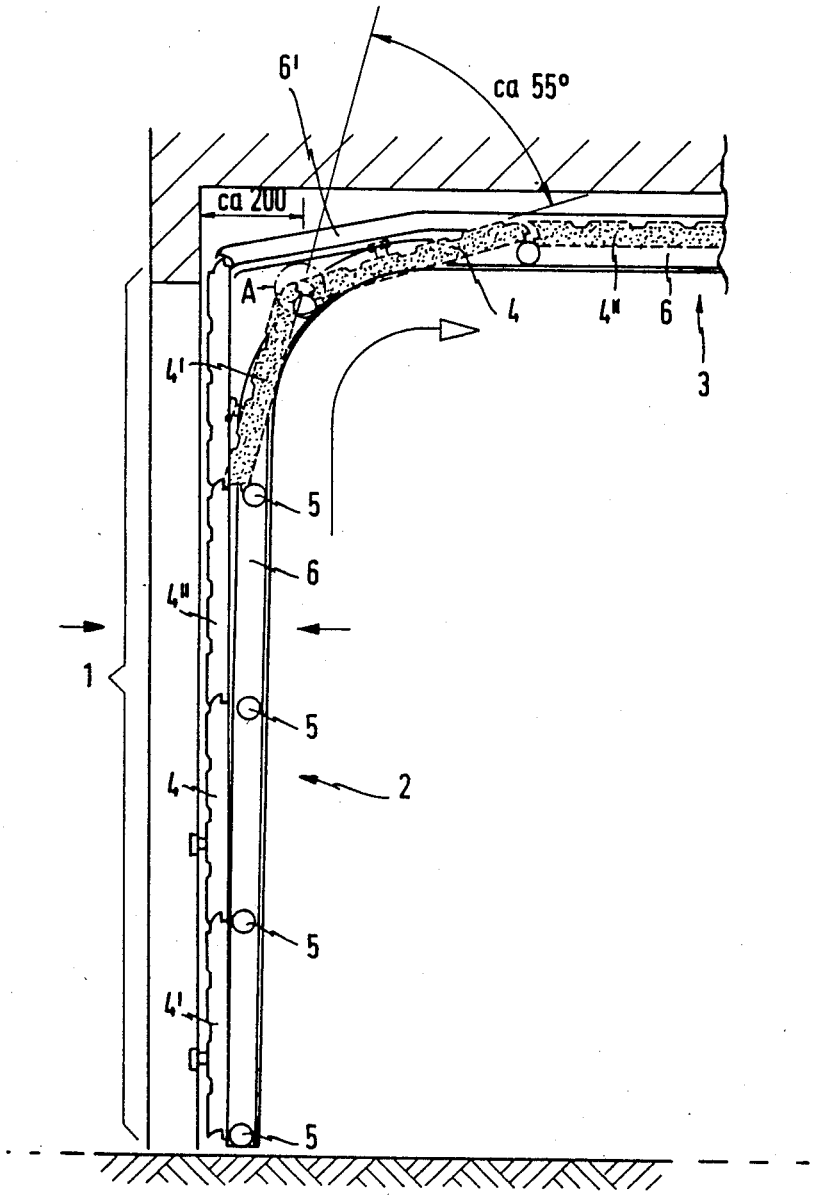
FIG. 1 is a schematic side view of an articulated overhead gate as in one of the embodiments.

The schematic side view in FIG. 1 illustrates an articulated overhead gate 1 or its panels with continuous lines in the closed state 2 and with broken lines in more or less the open state 3. A panel 4'is lowermost when the gate is closed, with an intermediate panel 4 just above it and a third panel 4''just above the intermediate panel. In the vicinity of the hinges between the panels are rollers 5 that travel in tracks 6 as is generally known in gates of this type. Each track comprises a vertical straight section associated with the gate-closed state, a curved transitional section, and more or less horizontal straight section associated with the gate-open state. A separate horizontal guide with a sloping transitional section 6'is associated with the upper rollers of the panel that is uppermost when the gate is closed. Its purpose is to guide the uppermost panel into the gate-closed state over a short path of vertical travel, as will be evident from FIG. 1. When the gate is closed, it has an outer surface 17 toward the environment and an inner surface 18 toward the inside of the building it closes off.

Figure 2:
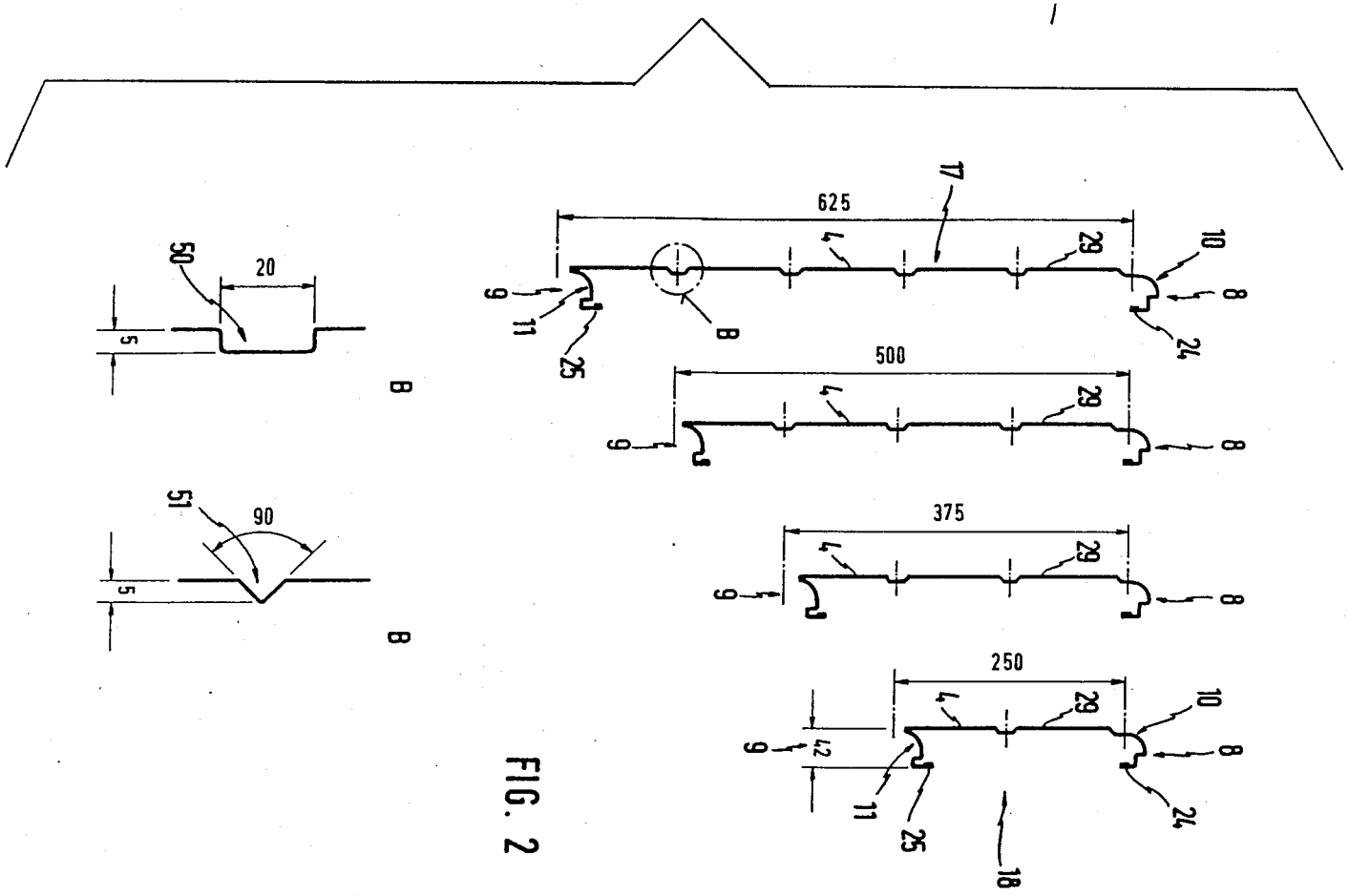
FIG. 2 illustrates one embodiment of a panel of various widths and with various types of groove.
Figure 4:
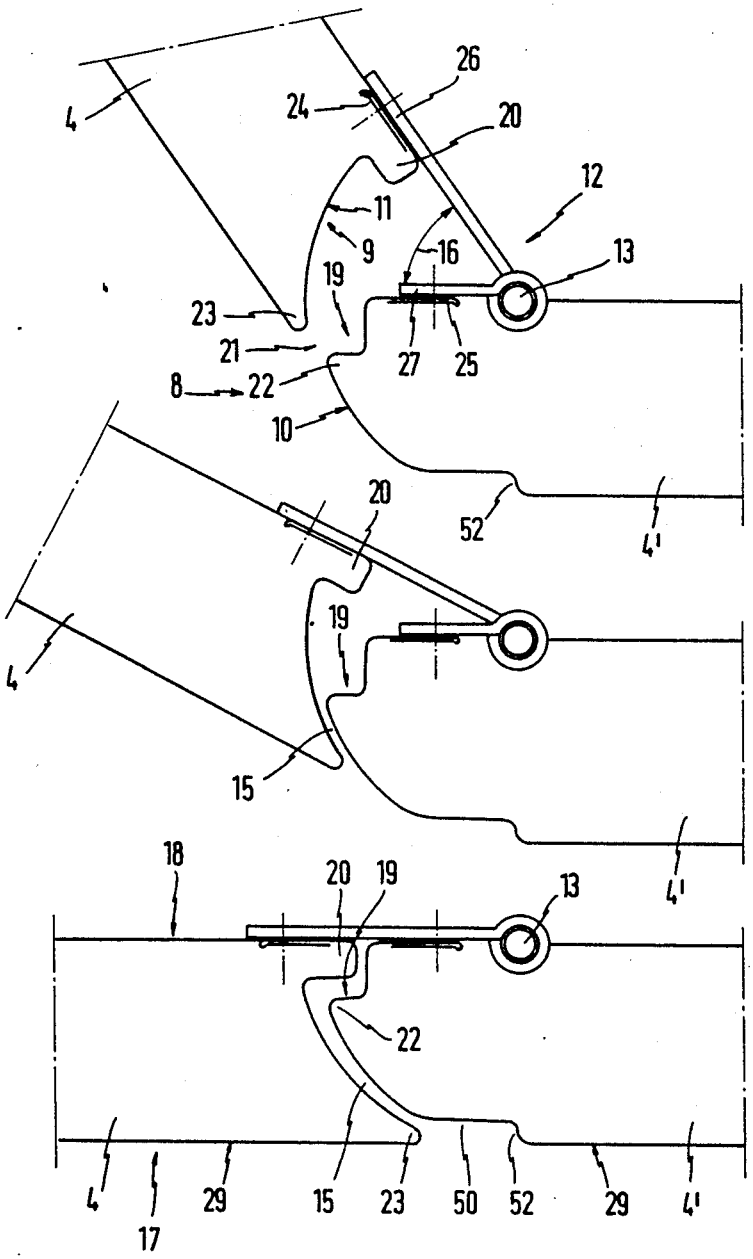
FIG. 4 is a side view of the section A illustrated in FIG. 1 between two panels of the design illustrated in FIG. 2 at maximum articulation, in an intermediate state, and straight, with the gate closed, that is.

FIG. 2 illustrates one embodiment of the panels in the form of a strip 29 of structural section with its widest surface facing outward and hence constituting a component of the outer surface 17 of the gate. As viewed from the inner surface 18 of the gate each panel is "open"-from its upper edge 24 to its lower edge 25. These edges extend across the direction that the gate moves in and are bent in to create a reinforced area for securing the flanges 26 and 27 of a hinge 12 as illustrated in FIG. 4.

Sectional panels 4 are provided with grooves 50 or 51 that extend over the total width of the panel perpendicular to the direction the gate moves in. These grooves are distributed in a prescribed vertical modulus and can have cross-sections of various shapes, with the grooves 50 in FIG. 2 having a rectangular cross-section and the grooves 51 in FIG. 2 having a triangular cross-section.

The top of FIG. 2 illustrates how the sectional panels 4 can have different widths in greater or lesser increments that derive in a practical way from the modulus of the grooves. This measure makes it possible to adapt the gate to gateways of different heights, to tracks of different curvatures, etc.

Figure 3:
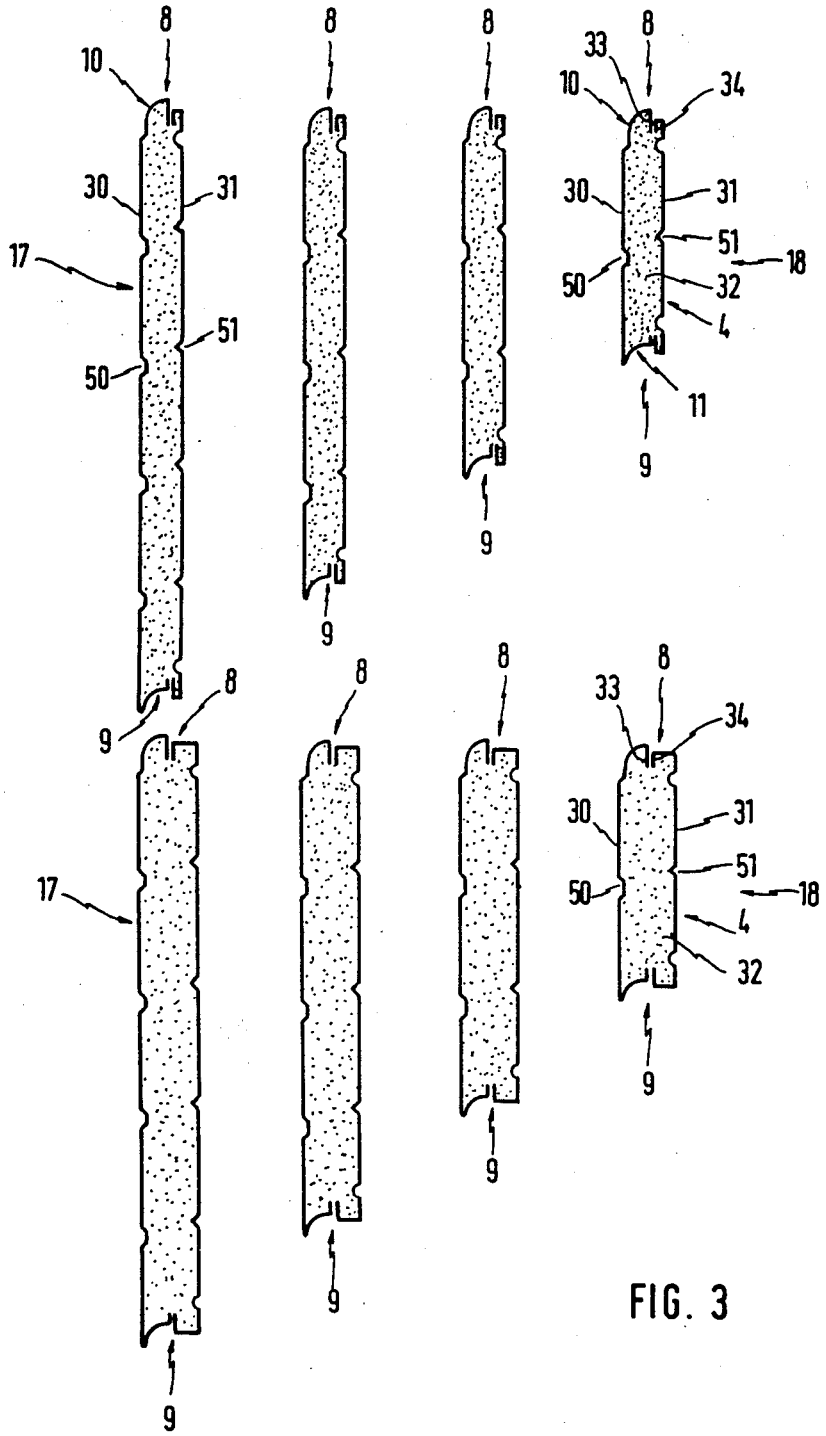
FIG. 3 illustrates further embodiments of panels that differ in width and thickness.

The two further panel embodiments illustrated in FIG. 3 are made out of two strips of structural section, with a strip 30 that is a component of the outer surface 17 of the gate paralleling an inner strip 31 that is a component of the inner surface 18 of the gate. The space between outer strip 30 and inner strip 31 is occupied by insulating foam 32 that also bonds the two surfaces together in a joint that is eventually augmented when the hinges are screwed on, as will be evident in particular from FIG. 6. The sides 8 and 9 of the panels are provided with flanges 33 and 34 at the edges of outer strip 30 and inner strip 31 that extend into the panels parallel with the gate and toward the other side. The flanges are buried in insulating foam 32.

The top of FIG. 3 illustrates comparatively slender two-strip panels 4 with widths that derive from the modulus of distribution of the grooves in the outer surface and can accordingly adapt to gateways of various heights. The panels 4 illustrated at the bottom of FIG. 3 are comparatively thick and also have widths that derive from the modulus of the grooves. From comparing the thinner with the thicker panels it will be evident that the outer strip 30 is of the same size in both, whereas the inner strip 31 differs in the distance between the inner surface of the panel, which is a component of the inner surface 18 of the gate, and its flange 34.

These panels also have grooves, rectangular grooves 50 at the outer surface 17 of the gate and triangular grooves 51 at the inner surface 18 of the gate, of the type illustrated at the bottom of FIG. 2.

FIG. 4 illustrates the vicinity of articulation between two adjacent panels 4 and 4' at various angles of articulation: at state 16 of maximum articulation at the top, in an intermediate state in the middle, and completely straight, with the gate closed, that is, at the bottom. FIGS. 4 through 7 in particular illustrate the configuration of the facing sides 8 and 9 of panels 4 and 4' that prevents the fingers from being inserted between the panels even at maximum articulation.

Certain areas of the facing sides of the panels are for this purpose curved to match each other and overlap in such a way as to form a space 15 that becomes smaller with increasing articulation as panels 4 and 4'articulate against each other around the axis 13 of hinge 12 over at least some or most of the transition into state 16 of maximum articulation. The particular curvature is at least the arc of a circle with its center at or, to compensate for tolerances, in the vicinity of the axis 13 of hinge 12.

The side 8 of bottom panel 4' that is uppermost in gateclosed state 2 in one preferred embodiment of the gate has a convex curved surface 10 and the side 9 of intermediate panel 4 that faces down when the gate is closed has a concave curved surface 11. Curved surfaces 10 and 11 extend more or less from the outer surface 17 of the gate over some or most of the thickness of the gate and terminate in a shoulder 19 and 20 respectively.

Convex curved surface 10 terminates in a concave mortise shoulder 19 that has a rectangularly recessed cross-section with one side perpendicular to and the other paralleling the surfaces 17 and 18 of the gate. Concave, curved surface 11 terminates in a resilient and projecting tenon shoulder 20 that also has a rectangular cross-section. When panels 4 and 4' are straight, in one plane, resilient and projecting shoulder 20 will completely engage concave shoulder 19 from the side as articulation increases, meaning that the recess constituted by concave shoulder 19 will be in the from of a groove with only two sides and will open toward the inner surface 18 of the gate.

As seen from the outer surface 17 of the gate, the concave curved surface 11 on the lower side of panel 4 meets the outer surface of the panel in a sharp edge 23. As seen from the inner surface 18 of the gate, the convex curved surface 10 on the upper side of bottom panel 4' meets concave shoulder 19 in a rounded edge 22. As will be evident from the upper illustration of state 16 of maximum articulation in FIG. 4, curved surface 10 and 11 no longer overlap once the articulation has proceeded to a certain extent, leaving a gap 21 between sharp edge 23 and rounded edge 22. The drawing should definitely be consulted in this context. Gap 21 is, however, not wide enough along the direction that the gate travels in to insert the fingers into in the space between sides 8 and 9 of panels 4 and 4'. The gap is preferably no wider than 4 mm.

As previously mentioned herein, the open-section panels have edges 24 and 25 at the inner surface 18 of the gate that are reinforced by being bent back on themselves. The flanges 26 and 27 of hinge 12 are secured to these reinforced areas as represented by the dot-and-dash lines in FIG. 4, which may be conceived of as representing the axes of screws for example.

The convex curved surface 10 on the upper side 8 of bottom panel 4' does not merge directly into outer surface 17 as viewed from that side but into the base, parallel with surface 17, of a rectangular groove 50, where it terminates in a shoulder 52 that connects the base of the groove to the outer surface of the associated panel 4', which is a component of the outer surface 17 of the gate. As will be evident from the bottom detail in FIG. 4, rectangular groove 50 is accordingly demarcated by its aforesaid base and laterally by shoulder 52 and sharp edge 23, making the groove resemble the other grooves in strip 29 of structural section (FIG. 2).

Figure 5:
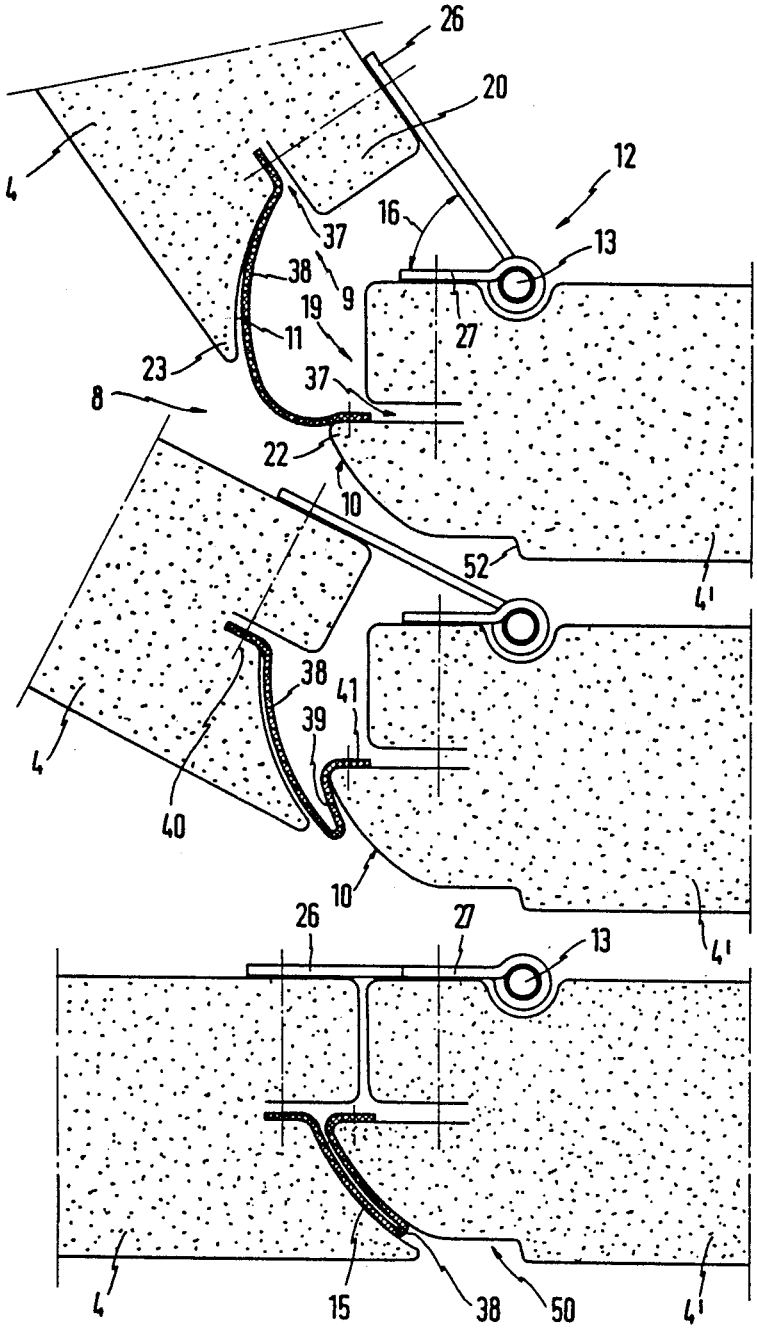
FIG. 5 is a view similar to that in FIG. 4 but in relation to panels of the type illustrated at the bottom of FIG. 3 and with one embodiment of a seal.
Figure 6:
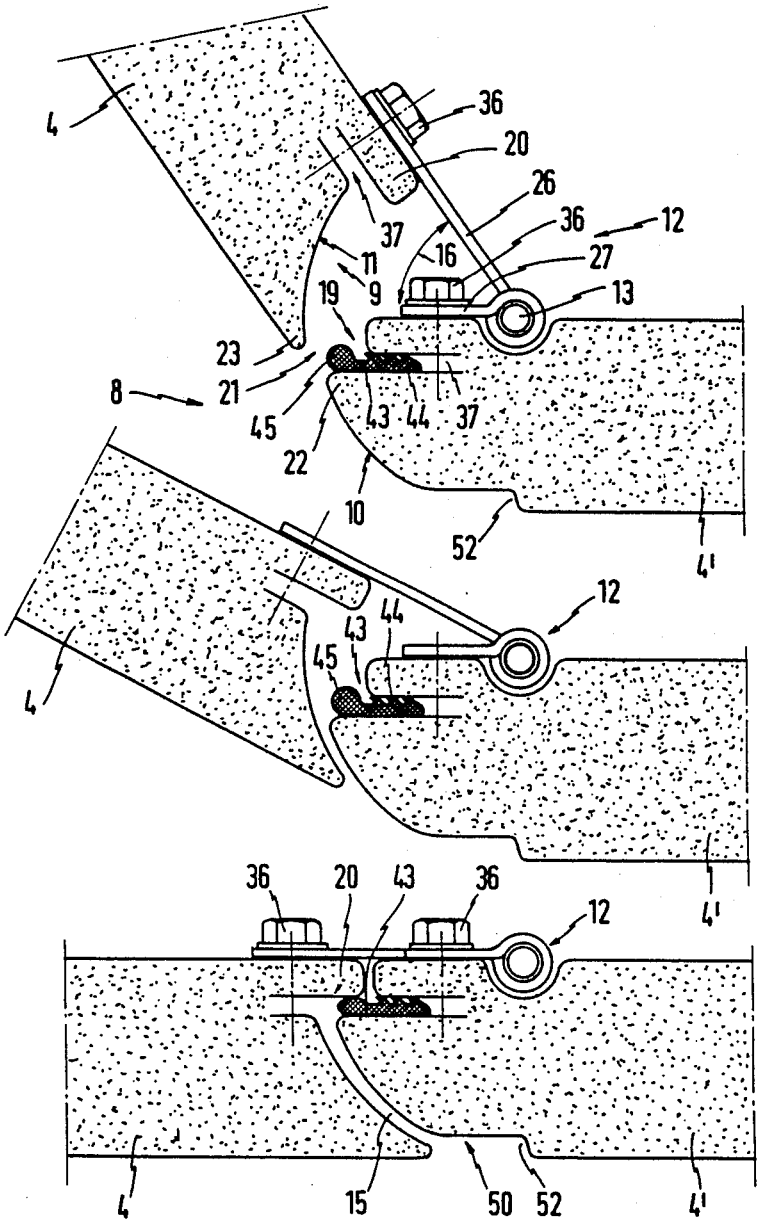
FIG. 6 is a view similar to that in FIG. 4 but in relation to panels of the type illustrated at the top of FIG. 3 and with another embodiment of a seal.
Figure 7:
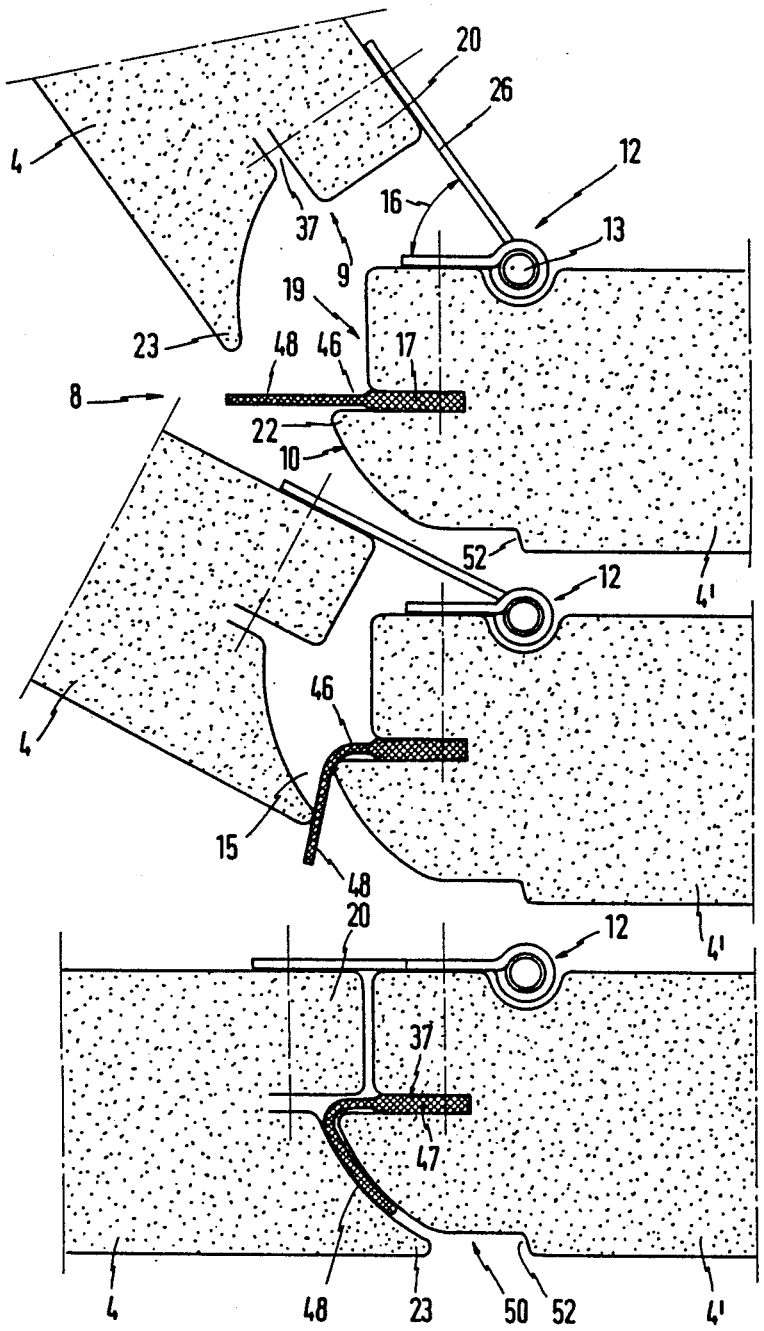
FIG. 7 is a view similar to that in FIG. 4 but in relation to panels of the type illustrated at the bottom of FIG. 3 and with a third embodiment of a seal.
Figure 11:
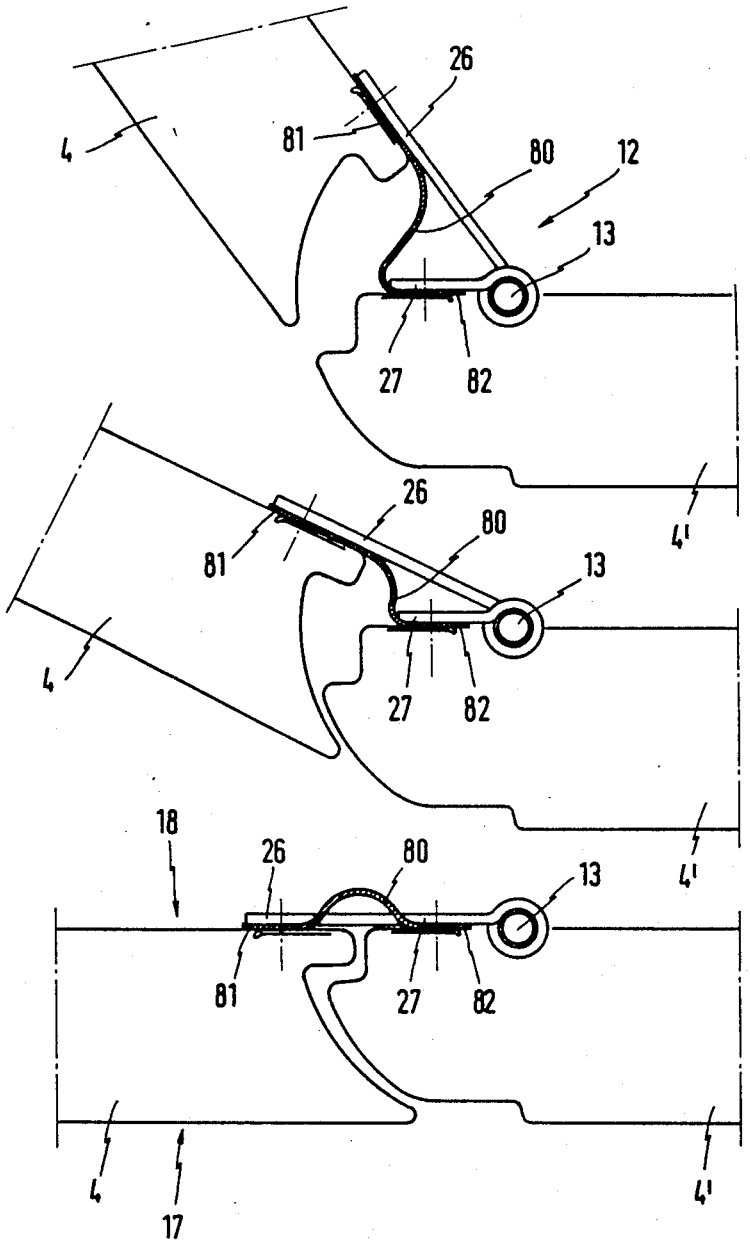
Figure 12:
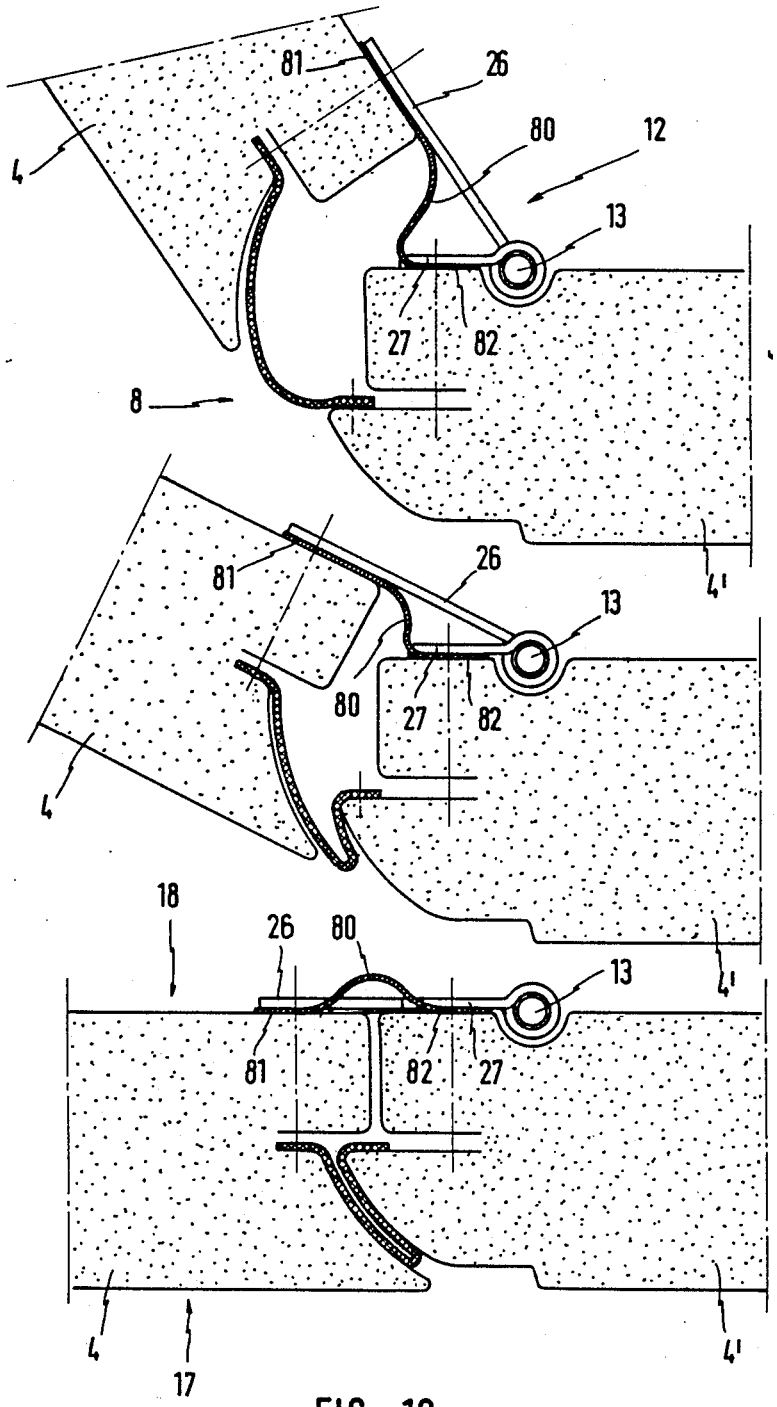
FIG. 12 is a view similar to that in FIG. 11 with one embodiment of a seal.
Figure 13:
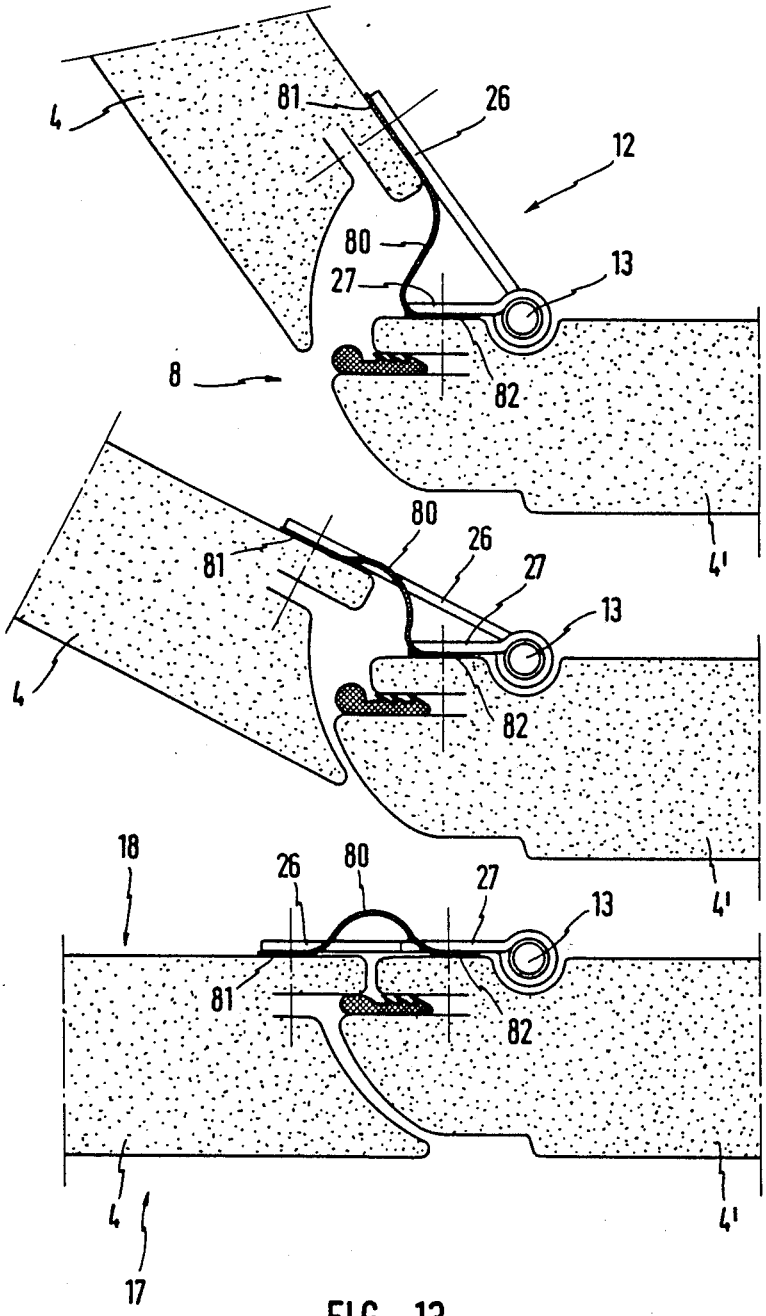
FIG. 13 is a view similar to that in FIG. 11 with another embodiment of a seal.
Figure 14:
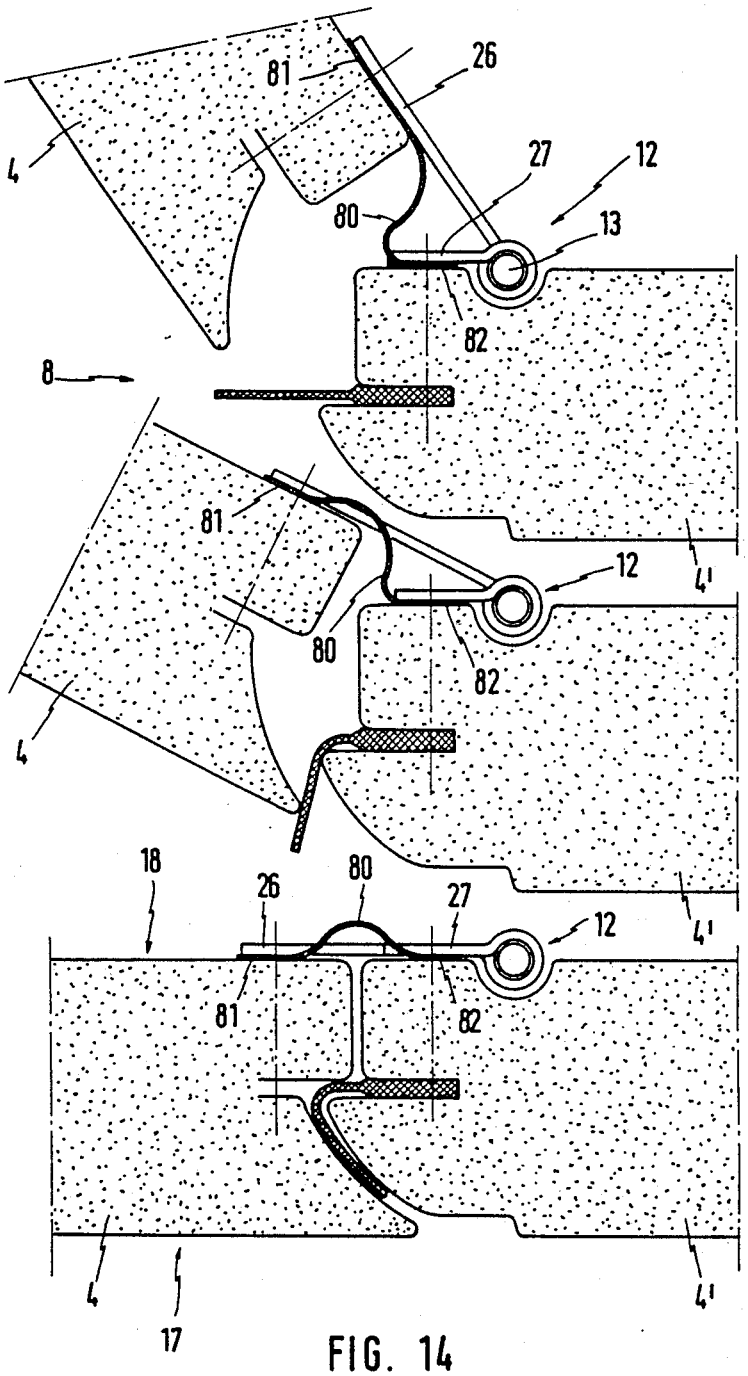
FIG. 14 is a view similar to that in FIG. 11 with a third embodiment of a seal.

FIGS. 5 through 7 illustrate the vicinity of the joint between panels made out of two strips of structural section as discussed with reference to FIG. 3.

The facing sides of adjacent panels are basically similar in shape to those specified with reference to the embodiment illustrated in FIG. 4. In particular, the convex and concave curved surfaces 10 and 11 on the sides 8 and 9 of the panels are basically similar to those specified with reference to FIG. 4. The same is true of concave shoulder 19 and resilient and projecting shoulder 20, of rounded edge 22 and sharp edge 23, and of the gap that they overlap. In contrast to the single structural-section embodiment illustrated in FIG. 4, however, there is a slot-like depression 37 between convex and concave curved surfaces 10 and 11 and between the adjacent shoulders, specifically concave shoulder 19 and resilient and projecting shoulder 20. These depressions are demarcated by the flanges 33 and 34 that extend into the panel from the edges of the outer and inner sectional strips 30 and 31 on panels 4 and 4' as will be evident from the figures.

The embodiments illustrated in FIGS. 5 through 7 employ special seals in the area between the facing sides 8 and 9 of adjacent panels 4, 4', or 4''. These seals can, due to their basic design, also be employed with the single-strip embodiment illustrated in FIG. 4. The type of joint between panels illustrated in FIGS. 4 through 7 can also be employed on the same gate. To simplify manufacturing, the bottom and top panels will be shaped like the others, with a convex curved surface in the side that is uppermost when the gate is closed and with a concave curved surface in the side that faces down when the gate is closed. The terminal edges of the gate can of course be designed different or be covered in such a way as to result in a different design.

The embodiment illustrated in FIG. 5 has a seal in the form of a bellows-pleated strip 38 with margins 40 and 41 that extend toward one of the sides 8 and 9 of the panels and are secured to them. In the present embodiment the margin 40 associated with upper panel 4 is inserted into the slot-like depression 37 between outer strip 30 and inner strip 31 and, as represented by the dot-and-dash lines, secured in that position by the screws that secure hinge flange 26. The other bellows margin 41 is secured to the side of the shoulder that extends toward slot-like depression 37 and terminates at rounded edge 22 as will be evident from FIG. 5.

As will be evident from the top of FIG. 5, which illustrates state 16 of maximum articulation, since bellows-pleated strip 38 engages the gap 21 between sharp edge 23 and rounded edge 22, the gap, which is wider in this embodiment than in the one illustrated in FIG. 4, will again be covered up to the extent that the fingers cannot be inserted into it, this time by bellows-pleated strip 38, which can be appropriately tensioned in this position.

As will be evident from the middle and bottom of FIG. 5, bellows-pleated strip 38 rolls into the space 15 created between convex curved surface 10 and concave curved surface 11 by the increasing overlap as articulation increases. A more flexible section 39 makes it possible to prescribe how seal 38 will roll into space 15 very precisely.

Bellows margin 41, which is associated with the side 8 that is uppermost when the gate is closed, can of course also be inserted into and secured in the slot-like depression 37 toward the inside and adjacent to rounded edge 22.

The embodiment illustrated in FIG. 6 is based on a thin panel made out of two strips of structural section, meaning that inner strip 31 is narrow in relation to the thickness of the gate as a whole, as will be especially evident from a comparison with the embodiments illustrated in FIGS. 5 and 7, in which the inner strip is thicker in relation to the thickness of the gate as a whole. Otherwise, the convex and concave curved surfaces and the shoulders, are similar in design, as has already been discussed with reference to FIG. 5 in relation to FIG. 4. All of the two-strip embodiments have the aforesaid slot-like depressions 37.

The embodiment illustrated in FIG. 6 has a seal in the form of a thick-beaded strip 43 secured by means of a marginal section 44 to the side 8 of bottom panel 4' that is uppermost when the gate is closed, specifically by inserting the marginal section into slot-like depression 37. The surface of marginal section 44 is shaped in such a way as to produce a barbing action that prevents thick-beaded strip 43 from slipping out of its position inserted in slot-like depression 37. The other marginal section of strip 43 has a thick bead 45 that rests against rounded edge 22 and, as articulation decreases, engages the inner side of the resilient and projecting shoulder 20 on the side 9 of the adjacent panel 4 that is lowermost when the gate is closed. FIG. 6 illustrates how tightness is obtained.

FIG. 6 also more or less concretely illustrates the screws 36 that penetrate the associated hinge flanges 26 and 27, inner strip 31. slot-like depression 37 in that sequence and engage the area of inner strip 31 behind those components. This measure increasingly reinforces the bond between outer and inner strips 30 and 31 constituted by the insulating foam, and the edges of seals can be secured in the vicinity of these screws as illustrated in FIGS. 5 through 7.

Since the marginal section 44 in the embodiment illustrated in FIG. 6 does not contribute to preventing the fingers from being inserted into a wide gap 21, the panels are designed to ensure that the distance between rounded edge 22 and sharp edge 23 will be accordingly narrow, preferably less than 4 mm wide, when the panels are at state 16 of maximum articulation.

The seal in the embodiment illustrated in FIG. 7 is a sealing-crest strip 46 secured by its marginal section 47 in the slot-like depression 37 between the flanges 33 and 34 on the upper and lower sides 8 of the outer and inner strips 30 and 31 of bottom panel 4'. Sealing-crest strip 46 can be partly or completely secured by the screws 36 that extend through hinge flanges 27.

Extending straight out of the marginal section 47 of sealing-crest strip 46 is a flap-like sealing crest 48 that extends during the state of maximum articulation as illustrated at the top of FIG. 7 into gap 21, which is, at that state of articulation, between the rounded edge 22 and the sharp edge 23 of facing sides 8 and 9. The fingers are accordingly again prevented in this embodiment from being inserted into an in itself wide gap 21 by sealing crest 48.

As articulation decreases as illustrated in the middle and at the bottom of FIG. 7, sharp edge 23 encounters sealing crest 48 and folds it into the gap that forms between the increasingly overlapping curved surfaces 10 and 11, establishing a reliable seal due to both resilience and compression as illustrated at the bottom of FIG. 7.

The embodiments illustrated in FIGS. 5 through 7 feature grooves 50 like those in the embodiment illustrated in FIG. 4. The groove 50 that occurs between two adjacent panels when the gate is closed is, like the other grooves in the panels themselves, wide enough to allow the fingers to be inserted in it without getting caught.

The strip 62 of sheet metal in the embodiment illustrated in FIGS. 8 and 9 has longitudinal grooves 61 and, in the vicinity of its longitudinal edges, two shoulders 63 and 64, and curved surfaces 65 and 66. The curved surface 65 on bottom panel 4' merges into shoulder 63 by way of a flat surface 67. Curved surfaces 65 and 66 then merge into foldbacks 68 and 69, creating two-layered terminations 70 and 71 that meet in a plane paralleling that of the panels when adjacent panels in the gate are in a vertical plane (FIG. 9). Each panel is in the form of a box that opens into the space that is to be closed off. The longest side of the panel is as wide as the gate. Terminations or elevations 70 and 71 are connected together by a strip 72 of plastic in the approximate shape of an H, although the strip illustrated in FIGS. 8 and 9 has double legs of different lengths. The middle of strip 72 of plastic is slightly constricted to create an axis 73 of articulation that coincides with the center of curvature of curved surfaces 65 and 66. Bores 74, represented by dot-and-dash lines extend in the embodiments illustrated in FIGS. 8 and 9 through terminations or elevations 70 and 71 and the legs of strip 72 of plastic, permanently or provisionally securing the strip to the panels. If strip 72 of plastic extends from one end of panels 4 and 4' to the sheet metal at the other end, which can consist of a structural section 75 or other component, the gap in the vicinity of the articulation between the two panels will be sealed tight with no need for any other means because the strip 72 of plastic that constitutes the joint also functions as a seal. The strip of plastic will simultaneously prevent the fingers from being inserted into the gap between two panels from inner surface 18 and accordingly protects the fingers from getting squeezed.

As will be evident from FIG. 10, a strip 72' of plastic can also have two pairs of legs of equal length.

FIGS. 11 through 14 refer back to FIGS. 4 through 7.

The embodiments illustrated in FIGS. 11 through 14 all have a sealing sheet 80 on inner surface 18 in the vicinity of hinge 12 that covers up the inner gap that occurs between two panels when they are mutually articulated. This measure prevents the fingers from being inserted into the gap from the inner surface of the gate as well. Each margin 81 and 82 of sealing sheet 80 is secured below a hinge flange 26 or 27, between the flange and its associated panel surface that is. This measure makes it possible to secure not only flanges 26 and 27 but also the associated margins 81 and 82 of sealing sheet 80. Since sealing sheet 80 deforms during articulation and must accordingly accommodate the maximum articulation between two panel, it will accordingly protrude out of the inner surface of the gate as it closes. This occurs in the illustrated embodiments in that sealing sheet 80 has recesses in the vicinity of overlapping hinge flanges 26 that allow it to curve out from the inner surfaces of panels 4 and 4' as will be evident from the bottom of FIGS. 1 through 14.

Another approach would be simply to apply sealing sheet 80 on top of the hinges and additionally secure it at least in the vicinity of bottom panel 4' with the other margin 81 wrapped around the free ends of hinge flanges 26.

Still another approach would be to allow the sealing sheet to deform into the gap that occurs between the panels as the gate closes, which could be attained by appropriately shaping its cross-section or prescribing how it would curve.

I claim:

1. An articulated overhead gate comprising: a series of adjacent and mutually articulated panels having sides facing one another; each panel having an uppermost side in a closed position of said gate, said uppermost side facing a preceding panel and having a curved surface being convex in vertical section; each panel having a lowermost side facing a subsequent panel, said lowermost side having a curved surface being concave in vertical section, each pair of adjacent panels having mutually facing convex and concave curved surfaces defining a curved space therebetween: hinge means connecting adjacent panels, said space being dependent on said hinge means; said hinge means having a pivot axis, said facing convex and concave surfaces shifting in relation to each other as they move about said pivot axis from the closed position of said gate to an open position of said gate, said space being reduced during at least part of said shifting of said facing convex and concave surfaces; said curved space extending from the panel's outer surface, corresponding to the gate's outer surface toward the gate's inner surface through at least a portion of the panel's thickness, said hinge means being connected to said panels on the gate's inner surface; a concave mortise shoulder formed by a surface extending outward from the convex surface and connecting to a surface extending toward the interior of the panel; a resilient tenon shoulder extending out of said concave surface and projecting outward from the side of the panel, said shoulders being located within the remaining portion of the panel's thickness; said shoulders engaging each other as a mortise and tenon joint in the closed position of the gate.

2. A gate as defined in claim 1, wherein said concave curved surface intersects in a sharp edge the panel's surface coresponding to the outer surface of said gate; said convex curved surface having a rounded edge at a location where said rounded edge meets said panel in a vicinity of the panel's surface corresponding to the inner surface of said gate; said rounded edge and said sharp edge on facing sides of two adjacent panels leaving a gap between said facing sides, said gap having a width not greater than 4 mm.

3. A gate as defined in claim 1, wherein said space is sickle-shaped in vertical section and tapers toward the outer surface of said gate.

4. A gate as defined in claim 1, wherein said convex and concave curved surfaces are substantially in form of an arc of a circle in vertical section, said circle having a center at least in vicinity of said pivot axis.

5. A gate as defined in claim 1, wherein said panels are comprised of a single strip of structural section, said panels having surfaces facing the gate's inner surface including reinforced sections of sheet metal with bent back edges at locations where said hinge means is connected to said panels.

6. A gate as defined in claim 1, wherein said panels are comprised of two strips of structural sections, one of said strips having a surface facing the outer surface of said gate, the other one of said strips having a surface facing the inner surface of said gate.

7. A gate as defined in claim 6, including a plastic bond between said two strips.

8. A gate as defined in claim 6, wherein said strips have flanges extending out of said sides and into the panels parallel to the inner and outer surfaces of said gate.

9. A gate as defined in claim 6, including a seal in said space.

10. A gate as defined in claim 8, wherein said flanges on said strips are separated by a slot-shaped depression therebetween.

11. A gate as defined in claim 8, including securing elements extending through said flanges for securing said hinge means to respective locations at the inner surfaces of adjacent panels.

12. A gate as defined in claim 9, wherein said seal comprises bellows-pleated strips extending between mutually facing sides and having deformable and resilient ends for securing said seal.

13. A gate as defined in claim 12, wherein said seal has a bulge out of the outer surface of said gate when said panels have pivoted a maximum amount about said pivot axis, said bulge covering up a gap between a rounded edge and a sharp edge on adjacent sides of said panels at the outer surface of said gate.

14. A gate as defined in claim 13, wherein said seal has a section of continuously increasing and decreasing flexibility at a location where said seal adjoins said rounded edge.

15. A gate as defined in claim 9, wherein said seal comprises a thick-beaded strip having one end section secured to the side with said convex curved surface on the outside of said convex curved surface; said thick-beaded strip having a thick bead at another end section engaging the side with the concave curved surface with said resilient tenon shoulder toward the outer surface of said gate.

16. A gate as defined in claim 9, wherein said seal comprises a sealing-crest strip having one end section secured to the side having the convex curved surface, said sealing-crest strip having a sealing crest extending freely out of another end section in form of a flap and entering said space at the side with the concave curved surface by encountering a sharp edge on the side of said concave curved surface when pivoting about said pivot axis decreases.

17. A gate as defined in claim 9, wherein said seal has at least one end section inserted into a slot-shaped depression in at least one of said sides; said depresson being formed by flanges on said two strips of structural section; and screw means extending through said flanges and said seal for securing said seal.

18. A gate as defined in claim 1, wherein surfaces of said panels on teh outer surface of said gate have grooves extending perpendicular to the direction of motion of said gate, said grooves resembling joints between said panels in a closed state of said gate when viewed from the outer surface of said gate, said grooves leaving a gap of the same width as that of grooves between a sharp edge on one side of a panel and a shoulder of an adjacent panel adjoining said convex curved surface.

19. A gate as defined in claim 6 wherein said strips of structural section have surfaces corersponding to the outer surface of said gate and being similar independent of the thickness of the panel.

20. A gate as defined in claim 1, wherein said hinge means comprises a plurality of individual hinges distributed over the length of said panels.

21. A gate as defined in claim 1, wherein said hinge means comprises a strip of plastic extending over the length of said panels.

22. A gate as defined in claim 21, wherein each panel has an elevation in vicinity of each longitudinal edge adjoining an adjacent panel, said elevation being as long as said panel, said strip of plastic having one end section secured to one of mutually facing elevations on adjacent panels so that said strip of plastic comprises a hinge and a cover for a gap between adjacent panels.

23. A gate as defined in claim 22, wherein said plastic strip has a substantially H-shaped cross-section with two pairs of legs joined by a web; free-ends of one pair of legs being closer to said web than of the other pair of legs.

24. A gate as defined in claim 23, wherein said plastic strip has a surface exposed on teh inner surface of said gate in substantially the same plane as the inner surface of said panels.

25. A gate as defined in claim 1, wherein said hinge means comprises a plurality of hinges distributed along the length of said panels, said hinges being separated from each other and having flanges secured to said panels at the inner surface of said gate; and a sealing sheet covering the area of said hinges over the total length of said panels.

26. A gate as defined in claim 25, wherein said sealing sheet has end sections below hinges in vicinity of said flanges of said hinges, said end sections being secured to said panels with said flanges.

27. A gate as defined in claim 26, wherein said sealing sheet has recesses in vicinity of said flanges of said hinges, said flanges covering a gap between adjacent panels, said flanges engaging respective recesses when said gate moves into the closed position.

28. A gate as defined in claim 26, wherein said sealing sheet has a predetermined point of curvature in vicinity of a gap between adjacent panels so that said sealing sheet deforms into said gap when said gate is in the closed position.

* * * * *